United States Patent [19]

Michal et al.

[11] Patent Number: 5,030,311

[45] Date of Patent: Jul. 9, 1991

[54] METHOD AND APPARATUS FOR TAPING LEAD AND TAIL ENDS OF WEB DURING WINDING ONTO A CORE

[75] Inventors: Vratislav M. Michal; William A. Meredith, both of Rochester, N.Y.

[73] Assignee: Eastman Kodak Company, Rochester, N.Y.

[21] Appl. No.: 415,931

[22] Filed: Oct. 2, 1989

[51] Int. Cl.[5] ..... B32B 31/18

[52] U.S. Cl. ..... 156/256; 156/354; 156/355; 156/516; 156/517; 156/521; 156/556; 156/567; 156/568; 242/56 R; 242/56.6

[58] Field of Search ..... 156/250, 256, 516, 517, 156/521, 522, 556, 568, 567, DIG. 6, DIG. 7, DIG. 9, DIG. 26, DIG. 33, 184, 185, 187, 354, 355; 242/56 R, 56 B, 56.6, 74

[56] References Cited

U.S. PATENT DOCUMENTS

| | | | |
|---|---|---|---|
| 2,585,227 | 2/1952 | Christman | 242/56.6 |
| 2,585,250 | 2/1952 | Jones et al. | 216/21 |
| 3,172,612 | 3/1965 | Besserdich | 242/56.6 |
| 3,235,433 | 2/1966 | Cuacho et al. | 156/354 |
| 3,322,600 | 5/1967 | Harrison et al. | 156/461 |
| 3,586,586 | 6/1971 | Berg | 156/521 |
| 3,834,963 | 9/1974 | Hoffman | 156/215 |
| 3,883,388 | 5/1975 | Amberg | 156/567 |
| 3,963,557 | 6/1976 | Patterson | 156/519 |
| 4,108,705 | 8/1978 | Hadl et al. | 156/355 |
| 4,328,066 | 5/1982 | Kiuchi et al. | 156/506 |
| 4,408,727 | 10/1983 | Dropczynski | 242/56 R |
| 4,475,970 | 10/1984 | Farrow et al. | 156/159 |
| 4,478,674 | 10/1984 | Clark | 156/505 |
| 4,604,154 | 8/1986 | Fosnaught | 156/264 |
| 4,650,537 | 3/1987 | Perecman | 156/518 |

FOREIGN PATENT DOCUMENTS 8202375 7/1982 PCT Int'l Appl. .

*Primary Examiner*—Caleb Weston

*Attorney, Agent, or Firm*—Charles E. Snee, III

[57] ABSTRACT

A method and apparatus are disclosed for taping the lead (10) and tail (20) ends of a web (12) during winding of the web onto a core (14), in which a vacuum drum (72) advances tape (66) past a cutter (126) to provide tape strips (16,22) to be applied when the drum initially is lowered into contact with the empty core and subsequently is raised and lowered again by a cylinder (36) into contact with the fully wound core.

26 Claims, 6 Drawing Sheets

METHOD AND APPARATUS FOR TAPING LEAD AND TAIL ENDS OF WEB DURING WINDING ONTO A CORE

DESCRIPTION

1. Technical Field

The present invention concerns techniques for taping the lead and tail ends of a length of web during winding of the web onto a spool or core. More particularly, the invention concerns a method and apparatus for cutting tape into strips of a desired length and applying such strips automatically to such lead and tail ends using a type of vacuum drum.

2. Background Art

Apparatus and methods for automatically labelling and taping various objects have been in use in industry for many years and have tended to be rather complex and difficult to maintain. For example, U.S. Pat. No. 2,585,250 shows a machine for applying labels to cylindrical containers in which a strip of labels is pulled around on a vacuum drum until a rotating, axially moving blade contacts the strip to sever it into individual labels. U.S. Pat. No. 3,586,586 discloses an apparatus for dispensing and applying random lengths of tape in which a friction feed drum pushes a continuous web of tape over a rotating vacuum drum until a desired length has been fed, at which point the strip is cut and rolled onto an object to be labelled and the feed drum is stopped to prevent movement of the web onto the vacuum drum until the labelling is completed. U.S. Pat. No. 3,834,963 discloses a method for applying labels to containers in which a web of labels is cut into strips before reaching a vacuum drum which moves the strips past a glue applicator and onto the container. U.S. Pat. No. 3,963,557 shows an apparatus for cutting a web of tape into strips which are transferred to a passing substrate, in which a segmented, articulated vacuum carrier acquires the tape and moves it past a rotating array of blades which coact with anvils on the carrier to cut the desired strips.

In the tape splicing apparatus shown in U.S. Pat. No. 4,328,066, the tape is carried on a vacuum drum having inwardly extending slots on its periphery through which a blade is moved axially to cut the tape into strips. The tape splicer disclosed in U.S. Pat. Nos. 4,475,970 and 4,478,674 includes a rectangular vacuum drum with flat sides separated by inwardly extending slots at the corners of the drum, into which slots a knife is forced radially to cut the tape. U.S. Pat. No. 4,604,154 shows a label cutting apparatus in which a web of labels is driven through a cutter before reaching a vacuum drum which then acquires and applies each label. The tape applicator shown in U.S. Pat. No. 4,650,537 includes a polygonal vacuum drum with anvils at each corner which coact with knives to cut tape carried by the drum into strips of uniform length.

While tape cutting and applying methods and apparatus of the type shown in the above patents have achieved certain measures of commercial and industrial acceptance, needs have continued to exist for simple and reliable taping and labelling methods and devices, particularly for use in taping the lead and tail ends of a web of material during winding onto a core or spool.

SUMMARY OF THE INVENTION

A primary object of the present invention is to provide an apparatus and method for cutting a continuous strip of tape into strips and applying such strips to secure the lead and tail ends of a web of indeterminate length.

Another object of the invention is to provide such an apparatus and method in which said strips may be applied to web ends on rotating bodies of different diameters.

Still another object of the invention is to provide such an apparatus and method for taping the lead and tail ends of a web, respectively, to a core or spool and to a completed roll of the web, while such core or spool is rotating.

These objects of the invention are given only by way of illustrative examples; thus, other desirable objectives and advantages inherently achieved by the disclosed invention may occur or become apparent to those skilled in the art in view of the following description. Nonetheless, the scope of the invention is to be limited only by the appended claims.

The method and apparatus of the invention are particularly suited for cutting strips of tape from a continuous wound roll and applying such cut strips to a translating or rotating object. A rotatably mounted vacuum drum is provided with a plurality of peripheral vacuum ports extending over a tape acquisition arc and a tape application arc. Tape from a rotatable roll is applied to the drum at the leading edge of the acquisition arc and drawn on the drum through the acquisition arc and at least partially through the application arc. The tape is then cut between the arcs, after which the vacuum in the acquisition arc is at least partially released to permit the drum to rotate beneath the tape while the cut strip is applied to such an object. Where the object is a core or spool being wound with a length of material, a strip is used to attach the lead end of the strip to the core and a further strip is used to attach the tail end of the strip to the outer convolution of the wound spool, thus requiring that the drum be moved from one application radius to another to accommodate the change in the outer diameter of the roll during winding. To prevent the wound material from loosely unwinding or "clockspringing" on the core, the tail end is held in place until the strip of tape has been applied.

BRIEF DESCRIPTION OF THE DRAWINGS

The foregoing and other objects, features and advantages of the invention will be apparent from the following more particular description of the preferred embodiments thereof, as illustrated in the accompanying drawings.

DETAILED DESCRIPTION OF THE PREFERRED EMBODIMENTS

Figures 1, 2, 3:
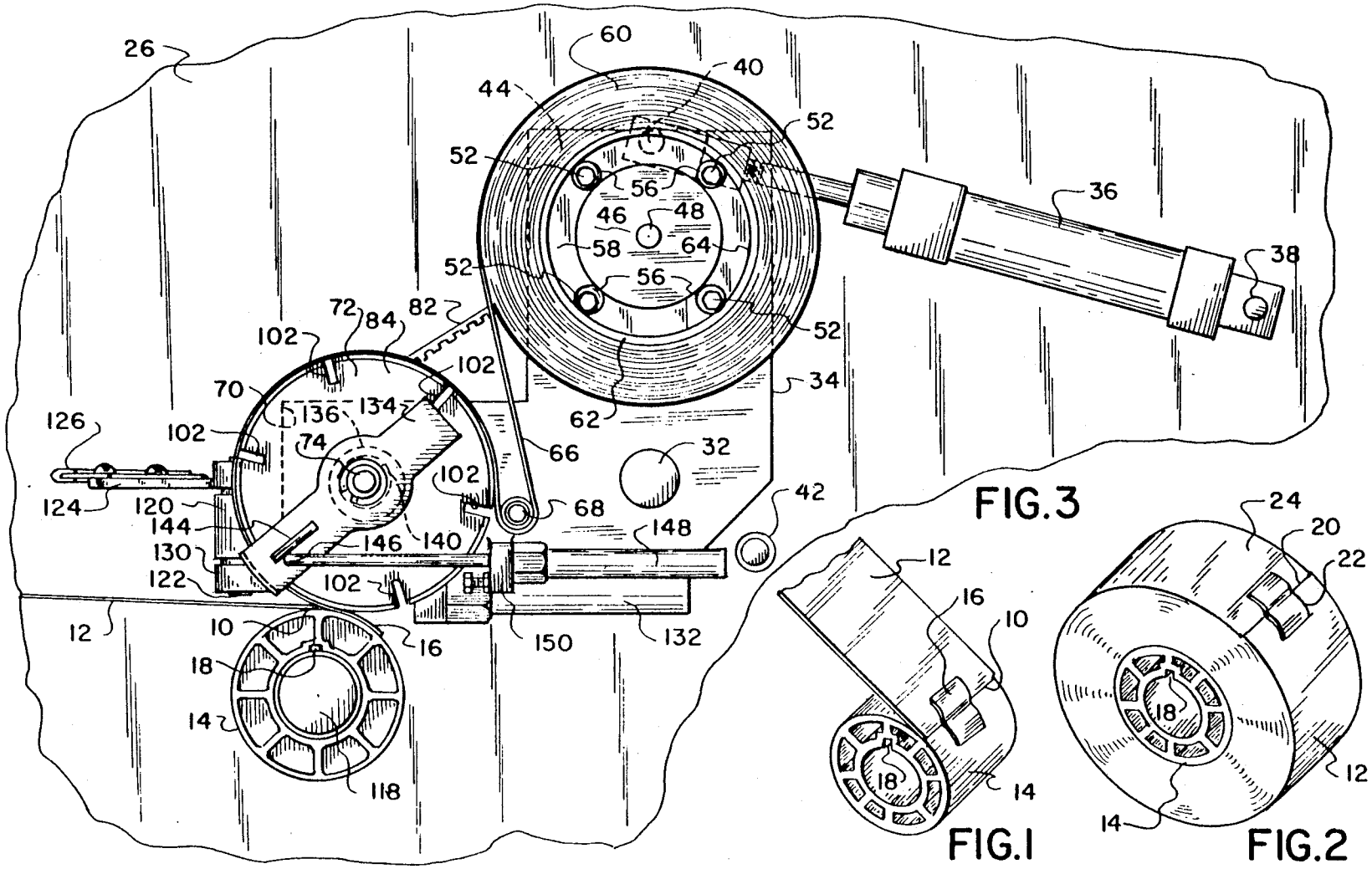
FIG. 1 shows a perspective view of a spool or core to which the lead end of a web of material has been attached with a strip of tape.
FIG. 2 shows a perspective view of a fully wound roll of material whose tail end has been attached to an underlying convolution with a strip of tape.
FIG. 3 shows an elevation view of the apparatus according to the invention, just as a strip of tape is being applied to secure the lead end of a web of material to a core or spool.

The following is a detailed description of the preferred embodiments of the invention, reference being made to the drawings in which the same reference numerals identify the same elements of structure in each of the several Figures.

FIGS. 1 and 2 illustrate the type of object with which the method and apparatus of the invention are particularly useful. The lead end 10 of a web 12 of material, such as photographic film, is attached to a core or spool 14 of conventional design by means of a strip of tape 16. Means such as a keyway 18 are provided to facilitate rotating core 14 during winding of web 12. When the roll of material has been completed, the tail end 20 of web 12 is attached by a further strip 22 of tape to the underlying convolution 24.

Figure 4:
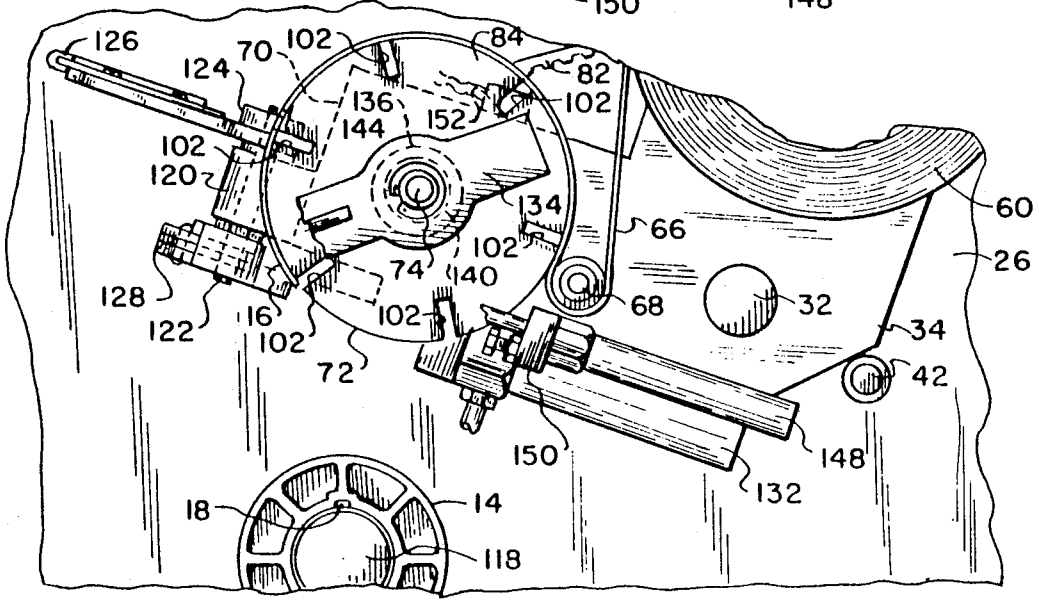
FIG. 4 shows an elevation view of the apparatus according to the invention, just as a strip of tape is being cut on the vacuum drum while the drum is elevated above the core or spool.

FIGS. 3 to 10 illustrate the apparatus according to the invention which is useful for automatically performing the taping and winding operations described with regard to FIGS. 1 and 2. An essentially vertical face plate 26, preferably of steel, is supported by a frame not illustrated. A bearing assembly 28 is attached to the back surface 30 of face plate 26 and rotatably supports a pivot shaft 32 which extends through face place 26. At the forward end of pivot shaft 32, an L-shaped frame plate 34 is fixedly attached to rotate with the shaft. A pneumatic or hydraulic cylinder 36 is pivoted at its head end to the front surface of face plate 26 by means of a pivot axle 38; and at its rod end, to frame plate 34 by means of a pivot axle 40. Thus, when cylinder 36 is actuated, frame plate 34 may be rotated between the fully raised position against rotational stop 42, as illustrated in FIG. 4, and the fully lowered position as illustrated in FIG. 3. In the fully raised position, tape is fed and cut into strips; whereas, in the fully lowered position and intermediate positions, the strips are applied to adjacent objects, as will be discussed subsequently.

Frame plate 34 includes an essentially upwardly extending arm 44 which supports on its front face an electric motor 46 whose output shaft 48 extends through arm 44 and supports a timing belt pulley 50, whose function will be described shortly. Motor 46 is securely attached to arm 44 by means of a plurality of bolts 52, four as illustrated, on a common bolt circle. The head ends 54 of bolts 52 capture a corresponding plurality of bearing rollers 56 between themselves and an annular tape roll guide plate 58. A roll 60 of single sided tape has a core 62 whose inner diameter 64 rides on rollers 56. A web 66 of tape is drawn sticky side out from roll 60 around a stationary, Teflon covered idler roller 68 located at the inner end of an essentially laterally extending arm 70 of frame plate 34.

From roller 68, the tape is passed onto the peripheral surface of a rotatably mounted vacuum drum 72 having a rearwardly extending shaft 74 mounted for rotation in a bearing block 76 mounted on the front face 78 of frame plate 34. Shaft 74 extends through frame plate 34 and has mounted on its rear end a timing belt pulley 80 of the type provided with an integral overrunning clutch, thus permitting drum 72 to be rotated by means of a timing belt 82 driven by pulley 50 and motor 46, or by contact with rotating core 14 or a rotating wound core.

Figure 6:
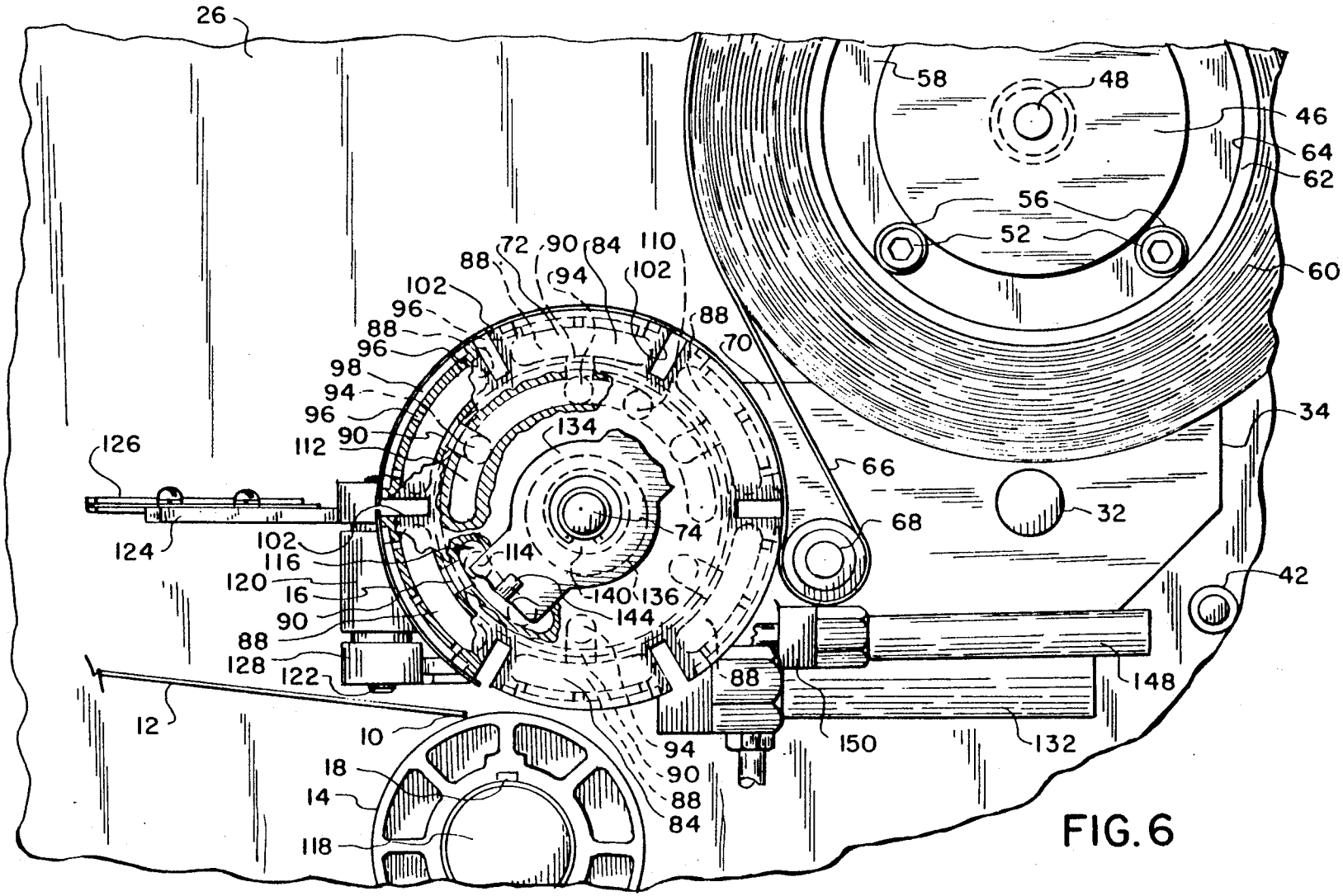
FIG. 6 shows an enlarged, partially broken away view of the apparatus of FIG. 3, just as the lead end of a web of material approaches the nip between the vacuum drum and the core or spool.
Figure 7:
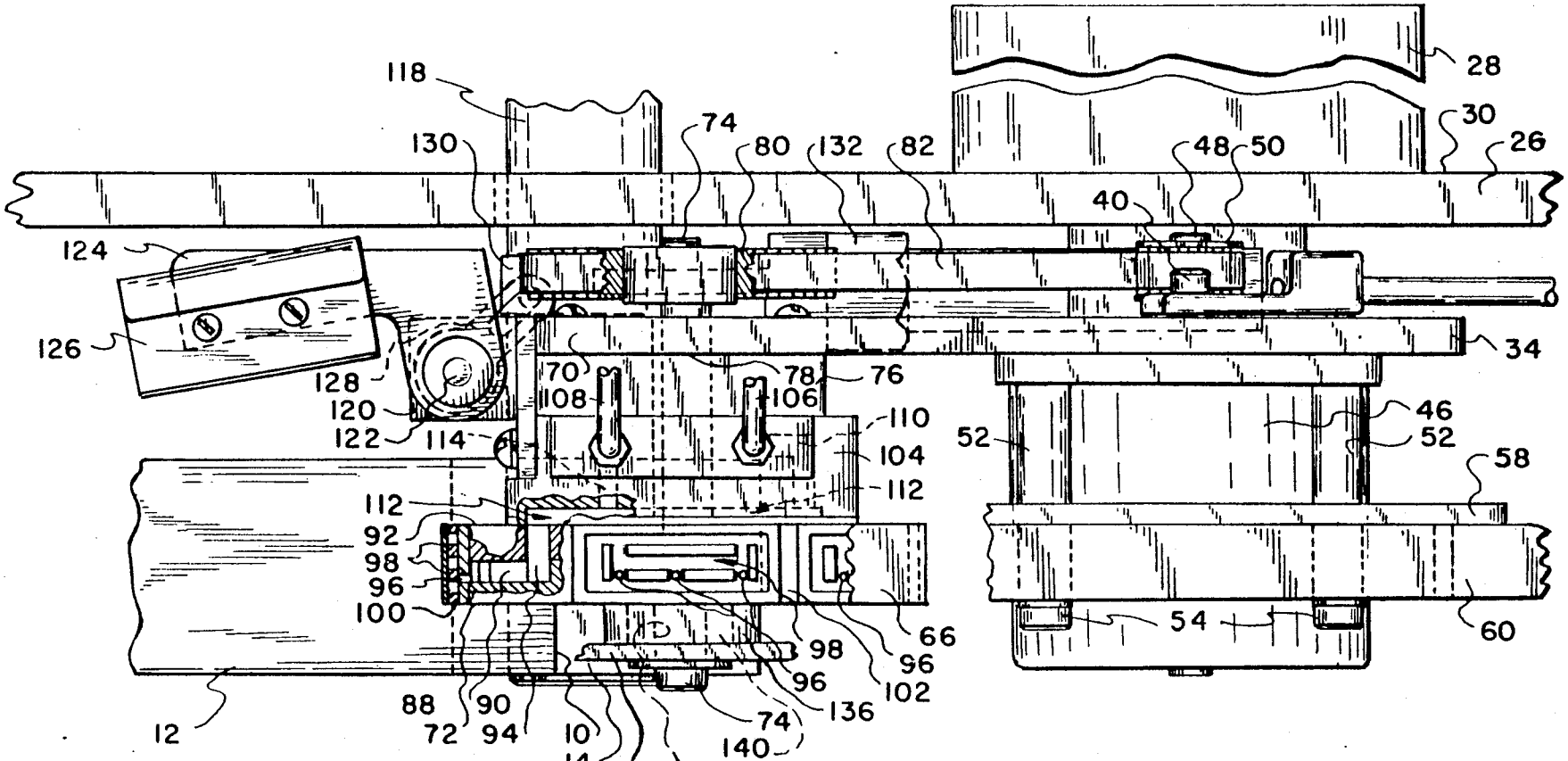
FIG. 7 shows an enlarged top view, partially broken away, of the apparatus of FIG. 6.

As best seen in FIGS. 6 and 7, vacuum drum 72 comprises a front face 84 which is flat and closed, through the center of which extends an outer stub portion of shaft 74. Vacuum drum 72 is a composite structure including, as shown fragmentarily in FIGS. 6 and 7, a front plate 86 having machined into its back surface a plurality of circumferentially extending arcuate slots 88. Each of slots 88 opens at its radially inner edge into a corresponding radially inwardly extending slot 90. Slots 88 and 90 are closed by a disk shaped back plate 92 having a plurality of axially extending bores 94, each aligned with the radially inner end of one of slots 90. Each of slots 88 is provided at its radially outer edge with a plurality, three as illustrated, of radially outwardly extending bores 96 which define ports opening into the bottom of grooves provided in one of a plurality of rectangular patterns 98 of grooves and lands molded or machined into a layer 100 of urethane plastic adhered to the periphery of vacuum drum 72. Between each pair of patterns 98 is provided a radially inwardly extending slot or recess 102, thus dividing the peripheral surface of vacuum drum 72 into a plurality, six as illustrated, of vacuum actuated tape holders. The circumferential length between the centers of slots 102 determines the minimum length of tape strips 16, 22.

Captured between bearing block 76 and back plate 92 is a vacuum manifold block 104 having a tape acquisition vacuum exhaust port 106 and a tape application vacuum exhaust port 108. Port 106 is connected via an internal passageway 110 to a circumferentially extending arcuate slot 112 in the front face of manifold block 104, at the same centerline radius as bores 94 in back plate 92. Slot 112 preferentially extends adjacent the top half of vacuum drum 72, which defines the tape acquisition arc of the apparatus. Port 108 is connected via an internal passageway 114 to a circumferentially extending arcuate slot 116 in front face of manifold block 104 at the same centerline radius as bores 94, as seen fragmentarily in FIG. 6. Slot 116 preferably extends essentially around the lower left quadrant of vacuum drum 72, which defines the tape application arc of the apparatus. The front face of manifold block 104 and the rear face of back plate 92 preferably are polished to ensure a smooth, minimum leakage sliding joint. If desired to minimize leakage, a seal such as a large O-ring may be included, not illustrated.

A core winding shaft 118 passes through face plate 26 via suitable bearings, not illustrated, and is driven by a suitable motor, also not illustrated. Shaft 118 is positioned to permit vacuum drum 72 to roll on core 14 in the position illustrated in FIG. 3.

Figure 5:
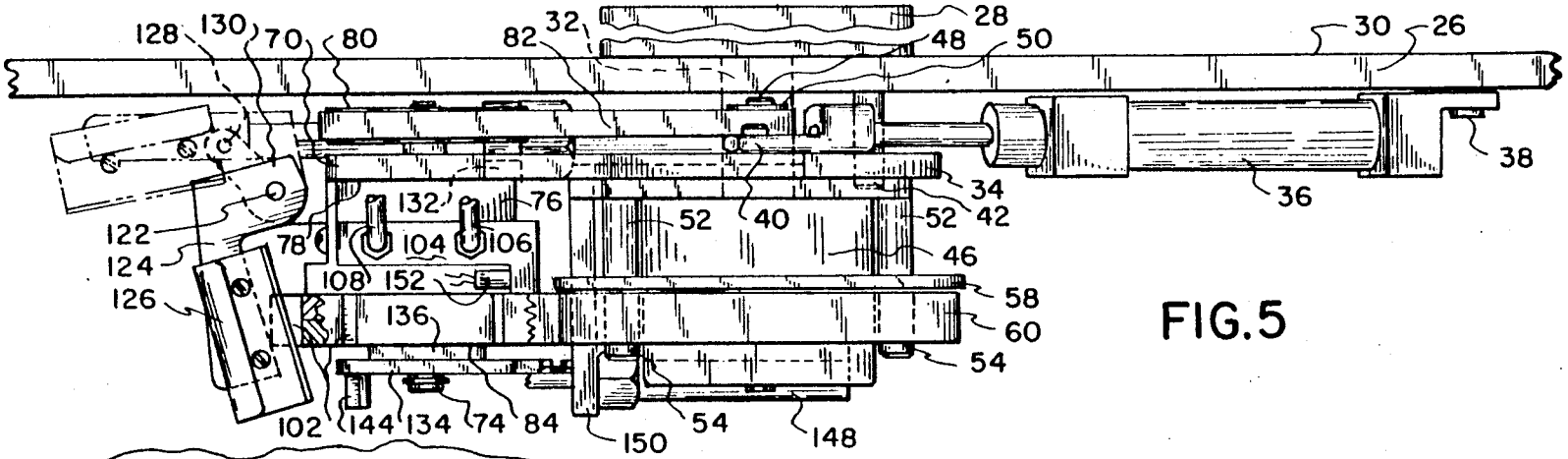
FIG. 5 shows a top view of the apparatus of FIG. 4.

As seen best in FIGS. 4, 5 and 7, an upwardly oriented bearing block 120 is attached to the outer end of arm 70 and rotatably supports a cutter actuation shaft 122 having attached to its upper end an L-shaped crank arm 124. A cutting blade 126 is removably attached to the outer end of crank arm 124 on about the level of the axis of vacuum drum 72; so that, when crank arm 124 is rotated, blade 126 will enter any one of slots 102 which is then aligned with the blade. At the lower end of shaft 122 is mounted a slotted crank arm 128 which is pivotably and slidably attached to the actuator rod end 130 of a pneumatic or hydraulic cylinder 132 attached to the lower edge of frame plate 34. Thus, when the rod of cylinder 132 is extended from the position of FIG. 6 to that of FIG. 5, blade 126 enters one of slots 102.

Figures 9, 10:
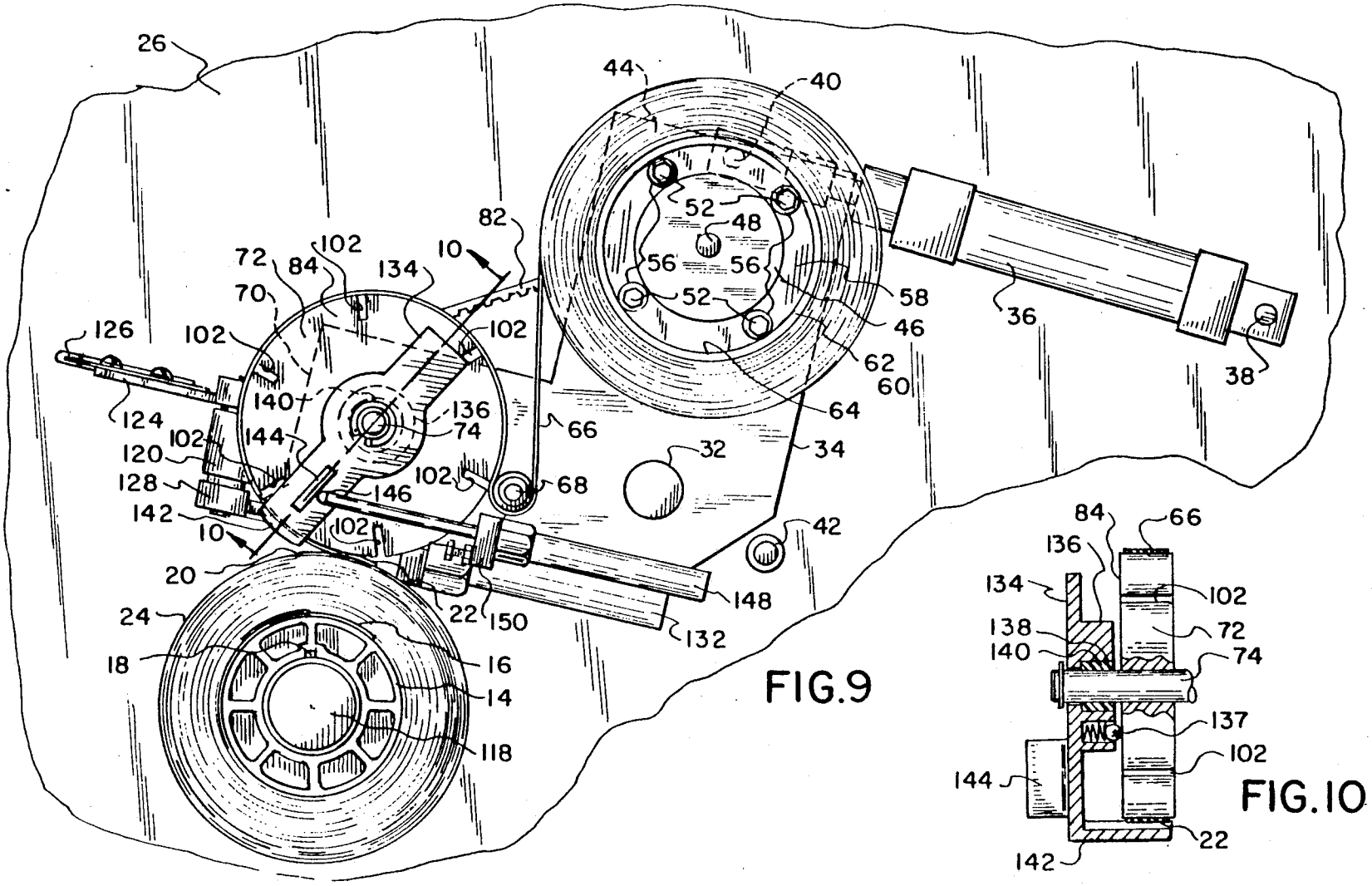
FIG. 9 shows the apparatus of FIG. 8, just after application of the strip of tape has begun.
FIG. 10 shows a fragmentary sectional view taken along line 10—10 of FIG. 9, illustrating the holder for the tail end of the web of material.

At the outer end of vacuum drum shaft 74 is rotatably mounted a retainer arm 134 for holding tail end 20 of web 12 prior to application of tape strip 22. Arm 134 comprises, as best seen in FIGS. 7 and 10, a rearwardly extending boss 136 having a central bore 138 which snuggly receives a bushing 140 having a central bore which surrounds shaft 74. Because of the fit of bushing 140 to shaft 74, arm 134 would be free to rotate around shaft 74 except for the presence of a plurality of spring ball plungers 137 provided in the wall of boss 137, as seen in FIG. 10. Plungers 137 provide friction between arm 134 and drum 72; so that, unless restrained, arm 134 will rotate with drum 72, for a purpose soon to be described. Arm 134 comprises at one end a rearwardly extending, radially outwardly curved foot 142 which extends parallel to the peripheral surface of vacuum drum 72 with sufficient clearance to allow tape strips to pass. Near the same end of arm 134 is a radially and axially extending abutment flange 144 positioned to be engaged by the end 146 of the actuator rod of a pneumatic or hydraulic cylinder 148 mounted on frame plate 34 by means of a forwardly extending bracket 150.

In operation, roll 60 of tape is placed on rollers 56 and a web 66 of tape is threaded under idler roller 68 and over the top of vacuum drum 72. Thus, the tape is initially applied to the drum after leaving roller 68, substantially at the leading edge of the tape acquisition arc. Cylinder 36 is actuated by known means to raise frame plate 34 to the position of FIG. 4. The rod of cylinder 148 is retracted. Vacuum drum 72 is then advanced using motor 46 until one of slots 102 is positioned opposite blade 126, at which point the drum is stopped. Preferably, this occurrence is sensed at one of the upstream slots 102, by means of an optical reflectance sensor 152, for example, as shown in FIGS. 4 and 5. Sensor 152 then provides a signal in the familiar manner to a conventional controller for the system, to apply vacuum at ports 106 and 108. Thus, web 66 adheres to the peripheral surfaces of rectangular patterns 98 due to the effect of the reduced pressure applied through bores 96. Cylinder 132 is then actuated by known means to extend its rod, thereby swinging blade 102 into the adjacent slot 102 and cutting the scrap from the lead end of the tape, the scrap then being removed by the operator. Vacuum drum 72 is then rotated by motor 46 until the next slot 102 is detected and the first strip of tape is then cut.

Meanwhile, known means not illustrated have placed a core 14 on shaft 118 and web 112 of material to be wound has been advanced to the position shown in FIG. 6. The vacuum acting at port 106 is then at least partially released to permit vacuum drum 72 to rotate beneath the tape. Cylinder 148 is actuated by known means to extend its rod and push retainer arm 134 to the position shown in FIG. 4 and FIG. 9 and restrain arm 134 from rotating with drum 72. The assembly is then lowered by cylinder 36 to the position shown in FIG. 6. Vacuum drum 72 contacts core 14 which is rotated by the motor driving shaft 118 and web 12 is advanced at equal speed toward the nip defined between the drum and the core. Friction between vacuum drum 72 and driven core 14 causes the drum to rotate due to the overrunning clutch in pulley 80. As vacuum drum 72 rotates in contact with core 14, the leading portion of tape strip 16 is rolled onto the exterior of the core. When lead end 10 of web 12 enters the nip, the continued rolling of vacuum drum 72 applies the rest of tape strip 16 to lead end 10. The vacuum acting at port 108 is then at least partially released and the vacuum at port 106 is reestablished. The assembly is then raised by cylinder 36 to the position shown in FIG. 4 and the core 14 is rotated rapidly to wind web 12 thereon. While such winding is proceeding, the previously described steps are repeated to prepare tape strip 22 for the tail end of web 12. However, before the tape is advanced to the position for cutting strip 22, cylinder 148 is retracted to permit retainer arm 134 to rotate with vacuum drum 72 to the upright position shown in FIG. 8.

Figure 8:
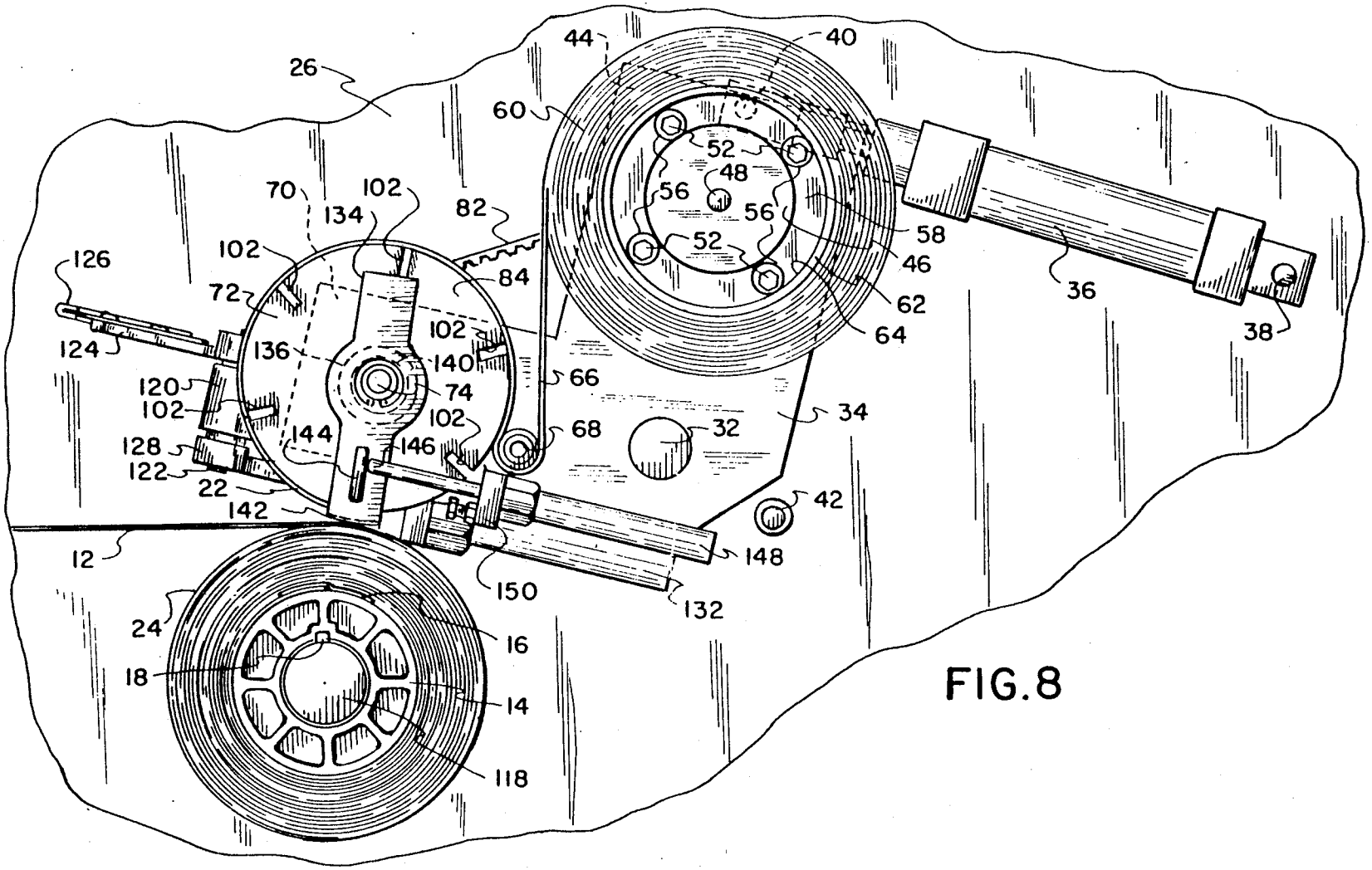
FIG. 8 shows an elevation view of the apparatus according to the invention, just as the vacuum drum has been lowered onto the wound roll but prior to cutting of the web of material and application of the strip of tape.

When the desired length of web 12 nearly has been wound on core 14, the assembly is lowered to the position shown in FIG. 8; so that, curved foot 142 rests on the surface of the outermost convolution of web 12. This prevents the wound roll from "clock-springing" when web 12 is cut. After web 12 has been cut by known means, shaft 118 is rotated a predetermined amount established by the point at which web 12 was cut, to bring tail end 20 to the position shown in FIG. 9, while curved foot 142 holds end 20 in place. Then, cylinder 148 is actuated to swing retainer arm 134 and to restrain it in the position shown in FIG. 9; so that, tape strip 22 contacts the roll and continued rotation of the wound roll causes vacuum drum 72 to apply tape strip 22 to complete the roll.

Having described our invention in sufficient detail to enable those skilled in the art to make and use it, we claim and desire to secure Letters Patent for:

1. An improved method for cutting strips of tape from a continuous length of tape and applying such cut strips to a translating or rotating object, comprising the steps of:

providing a source of a continuous length of tape;

providing a rotatably mounted vacuum drum having a peripheral surface with circumferentially spaced vacuum ports;

applying vacuum to said ports over a first tape acquisition arc and a second tape application arc while said drum is rotating;

applying a leading end of said tape to said drum substantially at the leading edge of said acquisition arc so that rotation of said drum withdraws tape from said source;

stopping rotation of said drum when a desired length of said tape has been drawn on said drum substantially through said acquisition arc and at least partially through said application arc;

cutting said tape to define a strip to be applied to such rotating or translating object;

at least partially releasing said vacuum at said acquisition arc to permit said drum to rotate beneath said tape and to permit said tape to remain stationary between said source and said drum;

rotating said drum through said application arc so that said strip is applied to such object;

at least partially releasing said vacuum at said application arc to release said strip for application; and reapplying said vacuum to said acquisition arc in preparation for a subsequent process cycle.

2. A method according to claim 1, wherein said vacuum drum is provided with at least one radially inwardly extending recess and said cutting step is completed by passing a cutting blade through said tape into said recess and withdrawing such cutting blade.

3. A method according to claim 1, wherein such object is a core on which a length of web is being wound, and the steps of claim 1 are repeated not only to secure the lead end of such web to an empty core, but also to secure the tail end of such web to a fully wound core, further comprising the steps of:

moving said vacuum drum away from such core while such length of web is being wound; and moving said vacuum drum into proximity with the wound core after such length of web has been wound to permit application of a strip of tape to such tail end.

4. A method according to claim 3, further comprising the step of holding such tail end against the wound core to prevent unwinding of the web prior to application of said strip.

5. A method according to claim 1, wherein said drum rolls said strip onto such object during said step of rotating said drum through said application arc.

6. A method according to claim 1, wherein during said releasing steps the pressure at said vacuum ports is increased to atmospheric.

7. Apparatus for cutting strips of tape from a continuous length of tape and applying such cut strips to a translating or rotating object, comprising:

a source of a continuous length of tape;

rotatably mounted vacuum drum means having a peripheral surface with circumferentially spaced vacuum ports for holding such tape to such surface during rotation of said drum means;

means for applying vacuum to said ports over a first tape acquisition arc and a second tape application arc while said drum is rotating;

means for applying a leading end of said tape to said drum substantially at the leading edge of said acquisition arc so that rotation of said drum withdraws tape from said source;

means for stopping rotation of said drum when a desired length of said tape has been drawn on said drum substantially through said acquisition arc and at least partially through said application arc;

means for cutting said tape to define a strip to be applied to such rotating or translating object;

means for at least partially releasing said vacuum at said acquisition arc to permit said drum to rotate beneath said tape and to permit said tape to remain stationary between said source and said drum;

means for rotating said drum through said application arc so that said strip is applied to such object;

means for at least partially releasing said vacuum at said application arc to release said strip for application; and means for reapplying said vacuum to said acquisition arc in preparation for a subsequent process cycle.

8. Apparatus according to claim 7, wherein said vacuum drum is provided with at least one radially extending recess and said cutting means comprises a cutting blade for passing through said tape into said recess.

9. Apparatus according to claim 7, wherein said object is a core on which a length of web is being wound and such strips are applied not only to secure the lead end of such web to an empty core, but also to secure the tail end of such web to a fully wound core, further comprising:

means for moving said vacuum drum away from such core while such length of web is being wound and moving said vacuum drum into proximity with the wound core after such length of web has been wound to permit application of a strip of tape to such tail end.

10. Apparatus according to claim 9, further comprising:

means for holding the tail end of such a length of web against the underlying wound core; and means for adjusting the position of such wound core to position such tail end for application of a strip of tape.

11. Apparatus according to claim 7, wherein said drum rolls said strip onto such object as said drum rotates through said application arc.

12. Apparatus according to claim 7, wherein said means for releasing increases the pressure at said vacuum ports to atmospheric.

13. Apparatus according to claim 7, wherein said means for cutting comprises a plurality of radially inwardly extending recesses in said peripheral surface, said recesses being spaced circumferentially to define the length of such strips of tape; at least one cutting blade; and means for passing said cutting blade through such tape into successive ones of said recesses to cut such strips when said drum has been stopped.

14. A method according to claim 2, wherein said arcs are circumferentially spaced and said recess is positioned between said arcs.

15. Apparatus according to claim 8, wherein said arcs are circumferentially spaced and said recess is positioned between said arcs.

16. An improved method for cutting strips of tape from a continuous wound roll and applying such cut strips to secure the lead end of a length of web to a core and, following winding of such length of web onto the core, to secure the tail end of such length of web to the wound core, comprising the steps of:

providing a rotatably mounted roll of tape;

providing a rotatably mounted vacuum drum having a peripheral surface with circumferentially spaced vacuum ports;

applying vacuum to said ports over a first tape acquisition arc and a second, circumferentially spaced tape application arc while said drum is rotating;

applying a leading end of said tape to said drum substantially at the leading edge of said acquisition arc so that rotation of said drum withdraws tape from said roll;

stopping rotation of said drum when a desired length of said tape has been drawn on said drum substantially through said acquisition arc and at least partially through said application arc;

cutting said tape between said arcs to define a strip to be applied to such core;

at least partially releasing said vacuum at said acquisition arc to permit said drum to rotate beneath said tape without withdrawing tape from said roll;

rotating said drum through said application arc so that said strip is applied to such lead end and core;

at least partially releasing said vacuum at said application arc to release said strip for application;

reapplying said vacuum to said acquisition arc in preparation for a subsequent process cycle;

moving said vacuum drum away from such core while such length of web is being wound;

moving said vacuum drum into proximity with the wound core after such length of web has been wound to permit application of a strip of tape to such tail end; and repeating said steps of stopping rotation, cutting said tape, at least partially releasing at said acquisition arc, rotating said drum and at least partially releasing at said application arc, so that a strip of tape is applied to such tail end.

17. A method according to claim 16, further comprising the step of holding such tail end against the wound core to prevent unwinding of the web prior to application of said strip.

18. A method according to claim 16, wherein said vacuum drum is provided with at least one radially inwardly extending recess and said cutting step is completed by passing a cutting blade through said tape into said recess and withdrawing such cutting blade.

19. A method according to claim 16, wherein said drum rolls said strip onto such core during said step of rotating said drum through said application arc.

20. A method according to claim 16, wherein during said releasing steps the pressure at said vacuum ports is increased to atmospheric.

21. Apparatus for cutting strips of tape from a continuous wound roll and applying such cut strips to secure the lead end of a length of web to a core and, following winding of such length of web onto the core, to secure the tail end of such length of web to the wound core, comprising:

means for rotatably mounting a roll of tape;

rotatably mounted vacuum drum means having a peripheral surface with circumferentially spaced vacuum ports for holding such tape to such surface during rotation of said drum means;

means for applying vacuum to said ports over a first tape acquisition arc and a second, circumferentially spaced tape application arc while said drum is rotating;

means for applying a leading end of said tape to said drum substantially at the leading edge of said acquisition arc so that rotation of said drum withdraws tape from said roll;

means for stopping rotation of said drum when a desired length of said tape has been drawn on said drum substantially through said acquisition arc and at least partially through said application arc;

means for cutting said tape between said arcs to define a strip to be applied to such core and lead end or to such wound core and tail end;

means for at least partially releasing said vacuum at said acquisition arc to permit said drum to rotate beneath said tape without withdrawing tape from said roll;

means for rotating said drum through said application arc so that said strip is applied to such core and lead end or to such wound core and tail end;

means for at least partially releasing said vacuum at said application arc to release said strip for application;

means for reapplying said vacuum to said acquisition arc in preparation for a subsequent process cycle; and means for moving said vacuum drum away from such core while such length of web is being wound and moving said vacuum drum into proximity with such wound core after such length of web has been wound to permit application of a strip of tape to such wound core and tail end.

22. Apparatus according to claim 21, further comprising:

means for holding the tail end of such a length against the underlying wound core; and means for adjusting the position of such wound core to position such tail end for application of a strip of tape.

23. Apparatus according to claim 21, wherein said vacuum drum is provided with at least one radially inwardly extending recess between said arcs, and said cutting means comprises a cutting blade for passing through said tape into said recess.

24. Apparatus according to claim 21, wherein said drum rolls said strip onto such core or wound core as said drum rotates through said application arc.

25. Apparatus according to claim 21, wherein said means for releasing increases the pressure at said vacuum ports to atmospheric.

26. Apparatus according to claim 21, wherein said means for cutting comprises a plurality of radially inwardly extending recesses in said peripheral surface, said recesses being spaced circumferentially to define the length of such strips of tape; at least one cutting blade; and means for passing said cutting blade through such tape into successive ones of said recesses to cut such strips when said drum has been stopped.

* * * * *